United States Patent [19]

Stoewer

[11] Patent Number: 4,854,491

[45] Date of Patent: Aug. 8, 1989

[54] RIVETING

[75] Inventor: Udo-Henning Stoewer, Bremen, Fed. Rep. of Germany

[73] Assignee: Messerschmitt-Boelkow-Blohm GmbH, Bermen, Fed. Rep. of Germany

[21] Appl. No.: 194,420

[22] Filed: May 13, 1988

[30] Foreign Application Priority Data

May 13, 1987 [DE] Fed. Rep. of Germany ..... 3715927

[51] Int. Cl.[4] ..... B21J 15/12

[52] U.S. Cl. ..... 227/58; 29/243.54; 227/51

[58] Field of Search ..... 227/51, 54, 55, 58; 29/243.54, 509, 524.1

[56] References Cited

U.S. PATENT DOCUMENTS

| | | | |
|---|---|---|---|
| 4,620,66 | 11/1986 | McClay et al. | 227/51 X |
| 4,515,302 | 5/1985 | Davern et al. | 227/58 |
| 4,662,556 | 5/1987 | Gidlund | 227/51 X |
| 4,676,422 | 6/1987 | Gidlund et al. | 227/51 |
| 4,759,109 | 7/1988 | Mason et al. | 227/51 X |

*Primary Examiner*—Paul A. Bell

*Attorney, Agent, or Firm*—Ralf H. Siegemund

[57] ABSTRACT

Construction parts, particularly in the aircraft industry, are interconnected as follows. A first major comonent includes (i) a first guide structure, (ii) means for mounting, guiding and holding a first pressure plate in the first guide structure, (iii) drill means movably disposed in the guide structure; (iv) rivet pin holding and guiding means movably disposed in the first guide structure, such that the rivet pin can be aligned with a drilled bore as drilled by the drill means; a second major component includes (i) a second guide structure; (ii) means for mounting, guiding, and holding a second pressure plate in the second guide structure; (iii) a rivet pin holder; (iv) a closure ring or sleeve feeding, holding, and positioning device; (v) and a closure ring or sleeve setting device; the two components are mounted and positioned such that (a) the two pressure plates are aligned whereupon (b) the rivet pin holder is aligned with the rivet pin holding means, through a bore as drilled by the drill means, and the closure ring or sleeve feeding device is alignable with the rivet pin holder as to holding of rivet pin in concentric relation to each other, and in concentric relation to the rivet ring a sleeve setting device.

5 Claims, 2 Drawing Sheets

RIVETING

BACKGROUND OF THE INVENTION

The present invention relates to the automatic control of drilling and riveting under utilization of a multi-part connecting element, the riveting involving connecting construction parts made of metal and/or fiber-reinforced synthetic such as are used particularly in the manufacture of aircraft.

Known devices for automatic riveting of parts under utilization of multi-part connection elements are usually quite large and bulky on account of a physically closed force path, for example, for deforming a closure ring or sleeve in conjunction with and as one element of a multipart connection element. The inherently large scale of the equipment limits their utilization and, in fact, this automated riveting has not been practiced widely in the aircraft industry for exactly that reason; there just is not enough room and space to fit the equipment in.

German printed patent application No. 26 35 635 describes a device for drilling and riveting of construction parts using single part rivets and a two-part riveting equipment. That equipment is indeed sufficiently small so that it can be used in aircraft manufacture. Here, then, the parts to be riveted are fixed to a carrier, frame or the like, and a tool carrier is provided for movement in two directions on that support frame. In order to obtain drilling and lowering and inserting as well as the forming of the rivet through appropriate tooling, the parts are forced from the side of the tool carrier as well as from the opposite side through holding and counteracting equipment in order to obtain the riveting. A computer control establishes control of the work cycle, including the positioning of the tool carrier as well as of the counter holder on the other side.

DESCRIPTION OF THE INVENTION

Under consideration of the manufacture in the aircraft industry particularly involving the connection of sheets and/or fiberreinforced components the utilization of multi-part connection elements should be attempted, using an automated or semi-automated, two-part drill lowering and riveting structure for purposes of interconnecting these construction parts.

It is, therefore, an object of the present invention to provide a new and improved method and equipment for drilling and riveting in an automatic fashion under consideration of the problems outlined above.

It is a specific object of the present invention to provide a new and improved method and equipment for automatically controlled drilling and riveting under utilization of at least a two- part connecting element and involving metal or fiber-reinforced synthetic parts to be interconnected and being fixed in a carrier.

In accordance with the preferred embodiment of the present invention the objects and here particularly the specific objects are realized in a two-component apparatus, wherein each (major) component includes a machine tool guide, one on the side of the rivet head and one on the closure ring side. Each of the major components alko includes a pressure plate; one unit includes a drill with a drill moving device; a device for feeding and holding of connecting (riveting) pins and being positioned for fitting the pin into a rivet hole as drilled into construction parts to be interconnected, and, in a particular point of connection, the second unit, and here particularly the second machine tool guide is provided, in addition to the a pressure plate, with a connecting pin (rivet) holder, a closure ring feeding and holder, and a closure ring and sleeve setting device. The two units are positionable in alignment across the bore being drilled to thereby align the rivet pin as inserted and the closure ring and sleeve as set.

The inventive method, is realized by the function of the apparatus or otherwise, and proceeds as follows. First, the major components are placed into position, which is a position of alignment of the tool guides on both sides of the pieces to be interconnected and in alignment with the drilled bore-to-be and the rivet-to-be-set. Next, the parts to be interconnected are clamped by means of the two pressure plates of the two units, and thereafter the drill is positioned and drills a through bore, Next, a connecting pin (rivet) is moved to the feeding and holding device on the first unit, and, in the meantime, the drill has stopped and has been returned to a starting position (e.g. by turning of the mounting turret, while a closure ring or sleeve is supplied from a suitable container to the feeding and holding device for closure rings or sleeves on the other side of the clamped parts. When in position, the pin holder on one side shifts the pin into the drill hole. The pin holder on the other side device is now closed around the inserted pin, and the closure ring or sleeve is positioned on the same side and shifted on top of the pin, whereupon the closure feed and holding structure is opened and retracted, to be replaced by the closure ring setting tool to the tension part of the pin. Next, the pin holder on the same side releases the pin and is retracted, and the closure ring or sleeve is deformed. The tear-off part of the pin is removed, and thereafter the pin holder or the turret releases the pin. Finally, the various parts are retracted, stopped, including, as the ultimate final step, the retraction of both pressure plates.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof will be better understood from the following description taken in connection with the accompanying drawings in which:

Figures 1, 3, 4, 5, 6, 7, 8, 9, 10, 11:
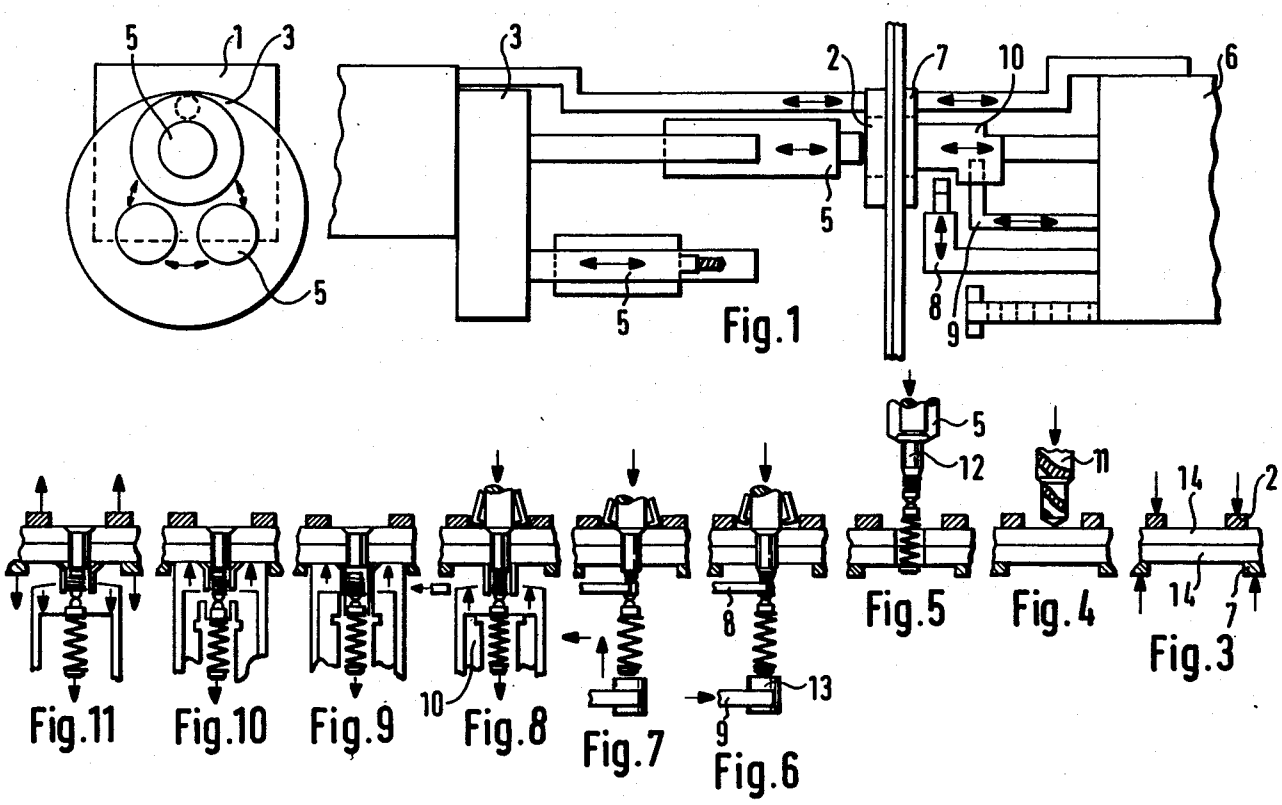
FIG. 1 is a cross-section through a two-part drill and riveting structure in accordance with the preferred embodiment of the present invention for practicing the best mode thereof.
FIGS. 3 through 11 illustrate basically the conduction of a work cycle by means of the machine and device shown in FIGS. 1 and 2, illustrating an automated version of the inventive method.
Figure 2:
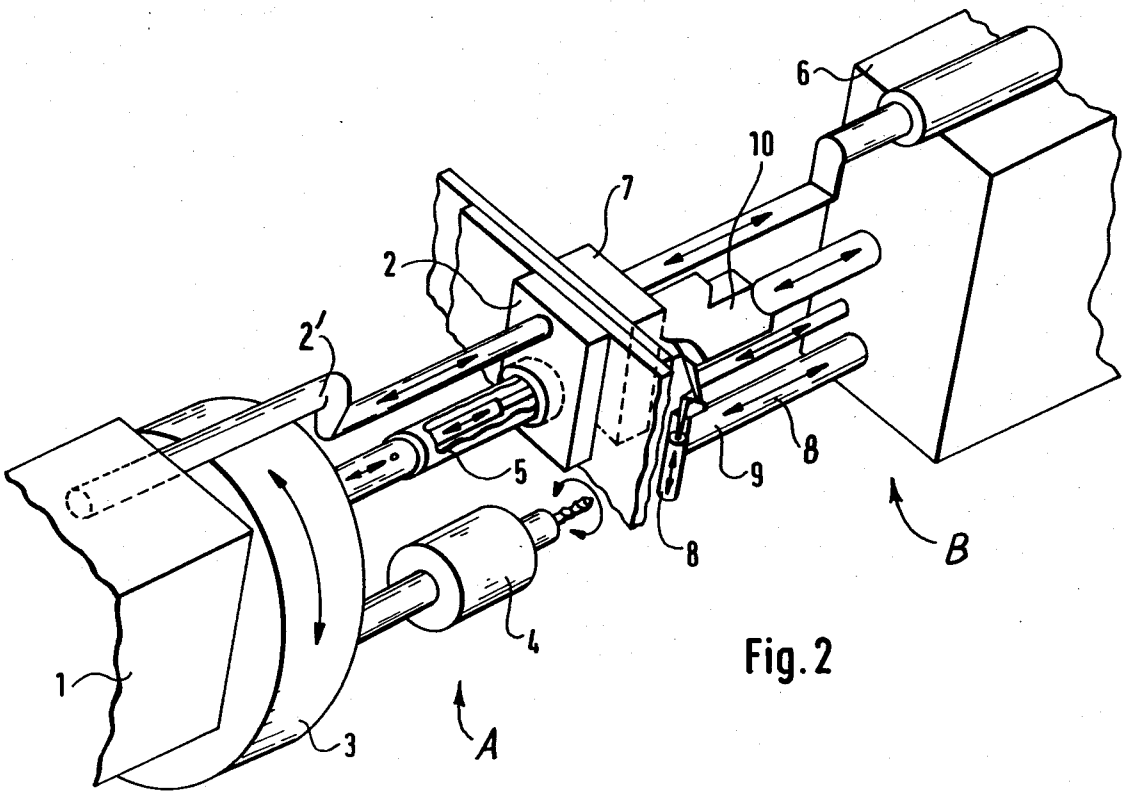
FIG. 2 is a perspective view of the device shown in FIG. 1.

Proceeding now to a detailed descrption of the drawings, FIG. 1 and 2 shown an automated two-part combined drilling and riveting device partially in perspective view, partially in section. The apparatus is comprised of two major components (A, B) which are, on one hand, mechanically (physically) separated and separable, but are positionable in relation to each other, in order to obtain the desired overall function as well as the coordinated and aligned detailing of the inventive method through the novel structure. Their functions are coordinated through a computer. There is one part and major component A disposed basically on the pin side, as far as riveting is concerned, being the side of insertion of the yet unset rivet. The second major component B is on the closure heat side of riveting.

Proceeding now to the description of the equipment and of the major component A on the pin insertion side, it includes a machine tool guide 1, holding a tool unit or turret 3 which is comprised of a revolving base $3^1$, holding a counter bore drilling device 4, and a holding and positioning device 5 for connecting and rivet pins 12. The turret 3 places the drill 4 or the pin holder 5 in alignment with a particular axis. Hence, once a bore is drilled by 4, on turning the turret, a pin on holder 5 is axially aligned with the bore. A pressure plate holder 2' is separately mounted to guide structure 1, i.e. it does not change position with the turret 3. Holder 2' holds a pressure plate 2, and is capable of axially advancing and retracting the plate 2.

The device B is the second major component on the closure heat sleeve or ring side, and includes a machine tool guide 6 for the machine tools of the second unit of the system. This equipment includes a second pressure plate 7 with axial displacemeent provided for it. A holding device 8 is provided for holding a rivet pin after it has been manipulated in a certain fashion. A feeder and holding device 9 for closure rings such as 13 is provided, and finally there is a closure ring setting tool 10. The parts to be interconnected are identified by reference numeral 14; they are, so to speak, physically separate from the two units A and B.

After having described the basic components with their respective constituents, a complete riveting cycle is automatically carried out as follows. At first the two mounting and guide units 1 and 6 are moved to attain a particular working position. This may be controlled by a computer and involves basically the considerations of accurate positioning. Briefly, what is involved is a lateral alignment of the components 14 with the various tool positions established by the holdes and guides 1 and 6.

As a direct consequence of moving these parts 1 and 6 along and towards the two parts 14 to be interconnected, the requisite position obtains. Next, the pressure plates 2 and 7 are moved towards each other and thus clamp the part 14 in between them. This holding and clamping action permits exact drilling, and riveting in an exact position towards which the various tool parts are aligned or alignable (FIG. 3).

FIG. 4 illustrates the beginning of drilling by drill bit 11 driven by a drill motor 4. Following retraction of the drill 4 with bit 11 by operationg of turret 3, the feeder device 5 for the connecting bolts or pins 12 is placed above the drill bore (FIGS. 2, 5) and a pin 12 is fed and inserted into the bore as is shown in FIGS. 5 and 6.

The pin 12 is still, at that point, held by the device 5, but it is also gripped on the other side by the device 8 (FIG. 6). Hence, devices 1 and 6 have originally been aligned such that the turret positioned drill and the pin holder are, on one side, aligned with the holder 8 of the other side, so that upon insertion of a pin 12 into a drilled bore, the holder 8 on that other side will grip the pin 12 with certainty. The two devices 5 and 8 together position the pin 12 in the bore hole.

In the meantime, a closure ring or sleeve 13 has been supplied by and through a suitable storage container, and the sleeve 13 has been placed onto the holder 9, which then feeds and positions that ring 13 from the closure heat side coaxially/telescopically onto the pin 12. This operation is shown in FIGS. 7 and 8.

Once the closure ring feeding and holding device 9 has fulfilled its function it is retracted and a closure ring or sleeve setting tool 10 is shifted over the pin 12 to act on sleeve 13. The holding device 8 is retracted from the pin, but note that pin 12 is still held on the other side by 5. The closure ring 13 is deformed by the tool 10 to obtain the desired rivet action. This is shown on FIGS. 8 and 9. FIG. 9 identifies the joint 12' to be torn off shortly. Device 5 can now release the pin 12, because parts 10' and 10'' hold the sleeve 13.

FIG. 10 illustrates that upon deforming the closure sleeve and ring 13 while the pin 12 is still being held, the closure ring or sleeve setting tool 10 actually exerts the requisite tear-off force in order to separate the tear-off part of the pin from the portion of the pin that remains as the connecting element. Reference 12'' identifies the zone of rupture. Finally, as shown on FIG. 11, the pressure plates 2 and 7 are retracted as separated from the parts 14 that have now been interconnected by riveting.

In furtherance of the invention, the set head and closure head side construction groups actually constitute a mechanical drilling and riveting unit which, as a whole, is movable along the parts 14 to be interconnected from one connect point to the next one. Modifications include, for example, a simplification by non-automatic but manually shifting a closure ring 13 onto a rivet pin that projects from the parts to be interconnected. The closure ring setting tool 10 may likewise be handled manually to complete the riveting, including tearing off of a part of the pin.

The invention is not limited to the embodiments described above, but all changes and modifications thereof not constituting departures from the spirit and scope of the invention are intended to be included.

I claim:

1. Two component apparatus for drilling rivet bores in construction parts to be interconnected by riveting, comprising:

a first one of the two components including (i) a first guide structure, (ii) means for mounting, guiding and holding a first pressure plate in the first guide structure, (iii) drill means movably disposed in the guide structure; (iv) rivet pin holding and guiding means movably disposed in the first guide structure, such that the rivet pin can be aligned with a drilled bore as drilled by the drill means;

a second one of the two components including (i) a second guide structure; (ii) means for mounting, guiding, and holding a second pressure plate in the second guide structure (iii) a rivet pin holder; (iv) a closure ring or sleeve feeding, holding, and positioning device; (v) and a closure ring or sleeve setting device; and the first and the second one of the components being mounted and positioned such that (a) the two pressure plates are aligned whereupon (b) the rivet pin holder is aligned with the rivet pin holding means, through a bore as drilled by the drill means, and the closure ring or sleeve feeding device is alignable with the rivet pin holder as to holding of rivet pin in concentric relation to each other, and in concentric relation to the rivet ring a sleeve setting device.

2. Apparatus as in claim 1, there being turret means as part of the first guide structure, for holding the drill means and the pin holder, for peacing the latter into alignment with a bore drilled by the former.

3. Method of automatically drilling and riveting construction parts, comprising:

clamping the parts from opposite sides of the parts;

positioning a drill tool on one side and drilling a bore through the parts;

moving a pivot pin to a holder and placing the pin above the bore under replacement of the drill tool and shifting the pin into the bore from the one side;

moving a closure ring or sleeve to the other side and positioning that ring or sleeve in alignment with the inserted pin, while gripping the pin from that other side;

retracting the ring or sleeve positioning device as the ring or sleeve is on the inserted pin;

retracting the pin holder from the other side and setting the ring or sleeve from that other side;

retracting pin holding from the one side; and releaving the clamping of the parts.

4. Method as in claim 3, ring or sleeve placing being carried out manually.

5. Method as in claim 3, setting of the sleeve or ring being carried out manually.

* * * * *